United States Patent [19]

Schmitt

[11] Patent Number: 4,564,470

[45] Date of Patent: Jan. 14, 1986

[54] FOLDER ASSEMBLY

[75] Inventor: Günter K. Schmitt, Würzburg, Fed. Rep. of Germany

[73] Assignee: Koenig & Bauer Aktiengesellschaft, Würzburg, Fed. Rep. of Germany

[21] Appl. No.: 738,318

[22] Filed: May 28, 1985

[30] Foreign Application Priority Data

Jun. 20, 1984 [DE] Fed. Rep. of Germany ..... 3422755

[51] Int. Cl.[4] ..... B41F 13/56

[52] U.S. Cl. ..... 270/21.1; 493/324; 270/5

[58] Field of Search ..... 270/45, 4, 5, 6, 7, 270/8, 20.1, 21.1; 493/343, 356, 321, 324

[56] References Cited

U.S. PATENT DOCUMENTS

| | | | |
|---|---|---|---|
| 1,160,444 | 11/1915 | Parker | 270/4 |
| 2,463,769 | 3/1949 | Higgins | 270/4 |
| 2,991,995 | 7/1961 | Zuckerman | 270/6 |
| 3,231,261 | 1/1966 | Huffman | 270/4 |
| 3,784,187 | 1/1974 | Takayana et al. | 270/6 |
| 3,889,939 | 6/1975 | Faltin | 270/21.1 |
| 4,108,067 | 8/1978 | Werner | 270/5 X |
| 4,167,265 | 9/1979 | Whittenberger | 270/5 X |
| 4,344,610 | 8/1982 | Jeschke et al. | 270/6 |
| 4,368,879 | 1/1983 | Hoshi | 270/6 |

FOREIGN PATENT DOCUMENTS

| | | | |
|---|---|---|---|
| 2614665 | 10/1976 | Fed. Rep. of Germany | 270/4 |
| 3030775 | 2/1982 | Fed. Rep. of Germany | 270/21.1 |
| 2110191 | 6/1983 | United Kingdom | 270/4 |

*Primary Examiner*—E. H. Eickholt

*Attorney, Agent, or Firm*—Jones, Tullar & Cooper

[57] ABSTRACT

A folder assembly for book folding in a web-fed rotary printing machine is disclosed. A paper web is printed and is then directed to a cutting cylinder, a cooperating folding blade cylinder and to a folding jaw cylinder. A pair of third or quarter folders are coordinated to the folding jaw cylinder. An upper one of these third folders is fixed and receives cross folded signatures from the folding jaw cylinder. A lower one of these third folders is shiftable laterally with respect to the upper third folder generally in a horizontal plane which is parallel to the axis of rotation of the folding jaw cylinder. A gripper cylinder is positioned intermediate the folding jaw cylinder and a transport tape system which is shiftable with, and which conveys signatures from the gripper cylinder to the lower third folder. Both upper and lower third folders can be operated concurrently or either one can be operated by itself in response to desired production demands.

7 Claims, 6 Drawing Figures

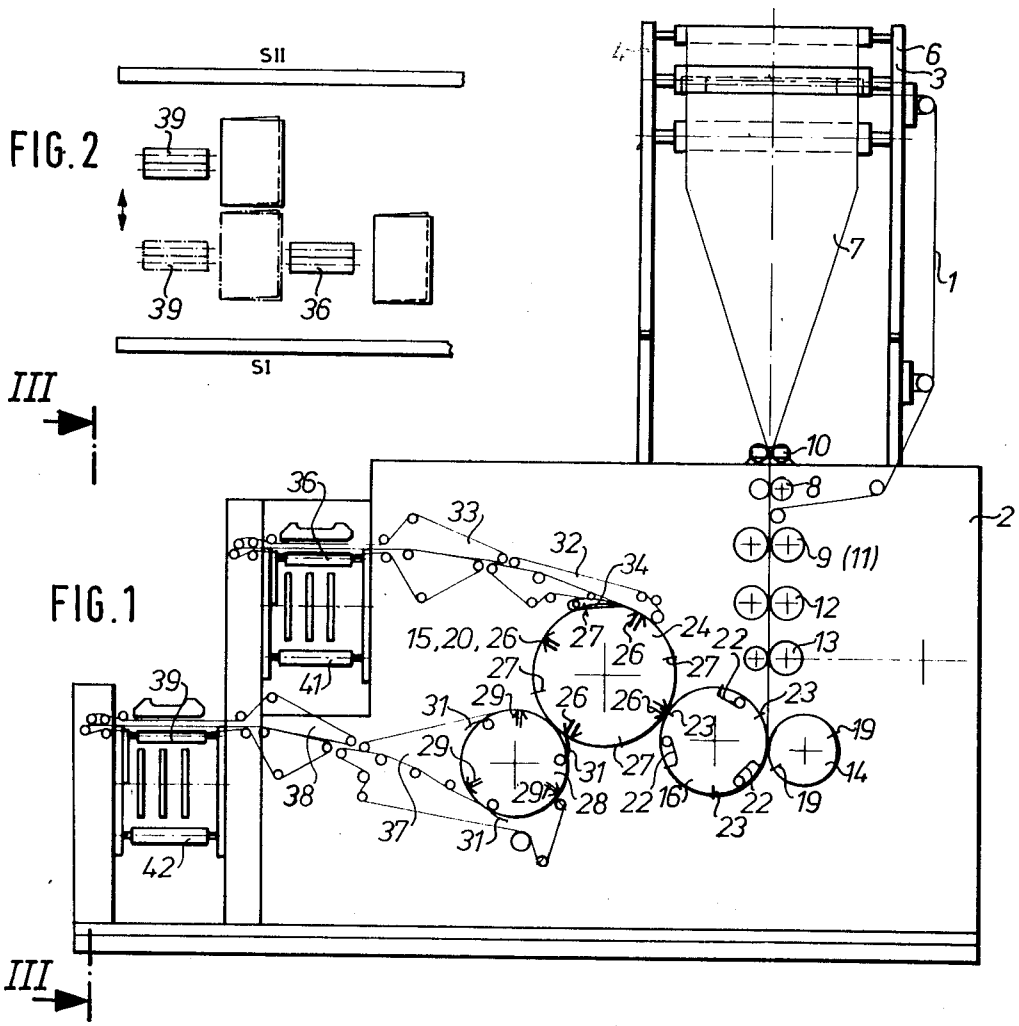
FIG. 1
FIG. 2
III
III
S11
S1
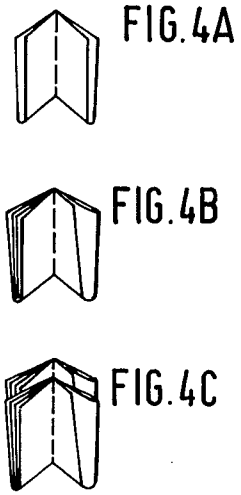
FIG. 4A
FIG. 4B
FIG. 4C

FOLDER ASSEMBLY

FIELD OF THE INVENTION

The present invention is directed generally to a folder assembly for book or signature folding in a web-fed rotary printing machine. More particularly, the present invention is directed to a folder assembly having at least two third or quarter folding units arranged at different levels. Most specifically, the present invention is directed to a folder assembly having upper and lower third fold arrangements with the lower third folder being displaceable parallel to the rotational axis of the folding jaw cylinder. The lower third or quarter folder is shiftable so that various folding proceedures can be accomplished in a folder assembly which is operable in either straight or collect run production and which is substantially less expensive than prior art devices.

DESCRIPTION OF THE PRIOR ART

Folder assemblies for book folding in web-fed rotary printing machines are generally known in the art. Exemplary of such folders in general is U.S. Pat. No. 4,190,243 to Michalik et al which is assigned to the assignee of the present application, and its counterpart, German published unexamined patent application No. 2 723 358, filed in Germany on May 24, 1977. Folder assemblies generally are also shown in German published examined patent application No. 2 512 368. These folder assemblies utilize various formers and turning bar and slitter assemblies to direct a printed web to a cutting cylinder and folding blade cylinder wherein the web is severed, may be collected, and is folded in a cross folded manner. From the folding jaw cylinder the product is typically directed to a quarter folder. In accordance with the prior art, it has been necessary to utilize at least two folding units plus two third or quarter folder arrangements in single circumference machines or four third fold arrangements in double circumference printing machines. This has required a substantial expenditure for folder cylinders and their accessory machine elements such as drive gearing and control means and the like. Additionally, these prior art assemblies have required substantial amounts of space and have had quite extensive paper web paths.

Displaceable folders generally are known as may be seen in French Pat. No. 686001. Rhythmically controlled signature switches are also generally known, as may be seen in German published examined patent application No. 2 107 595. However, these prior art devices have not previously been operable to provide a folder assembly having the flexibility and economy of operation of the folder assembly in accordance with the present invention.

SUMMARY OF THE INVENTION

It is an object of the present invention to provide a folder assembly for book folding.

Another object of the present invention is to provide a folder assembly having at least two third or quarter folders.

A further object of the present invention is to provide a folder assembly for book folding in which one of the third folders is shiftable.

Yet another object of the present invention is to provide a folder assembly having upper and lower third folders.

Still a further object of the present invention is to provide a folder assembly for book folding in which the lower third folder is displaceable along a horizontal plane.

Yet still another object of the present invention is to provide a folder assembly for book folding which significantly reduces the amount of equipment and space previously required.

As will be discussed in greater detail in the description of the preferred embodiment which is set forth subsequently, the present invention is directed to a folder assembly for book folding in a web-fed rotary printing machine in which a pair of spaced, relatively movable third or quarter fold assemblies are provided. A web of paper, which has been printed in either a single or double circumference printing couple, is fed to a cutting cylinder and cooperating folding blade cylinder either through a former which places a first longitudinal fold in the web, or through a turning bar and slitter assembly. The web is severed into signatures and is given a first cross fold by the folding blade cylinder which cooperates with a folding jaw cylinder. The cross folded signatures are then directed through suitable transport tapes to upper and lower third or quarter fold arrangements. These third or quarter folders impart a longitudinal fold to the signatures and deliver them to further processing means.

The upper third folder is fixed while the lower third folder is displaceable and securable in one of two positions. This lower third folder is movable in a generally horizontal plane which is parallel to the axes of rotation of the folding blade and jaw cylinders. In contrast to the prior art devices, the folding assembly for book folding in a web-fed rotary printing machine in accordance with the present invention results in a substantial savings on folder cylinders and their related drives and the like. Additional savings in equipment result because of the reduced numbers of angle bars, paper guide rollers and the like which are no longer required. Furthermore, the paper web paths traveled by the printed web can be substantially shortened. This is due to the movable placement of the lower third or quarter folder in conjunction with the upper fixed third folder. The previously required two folding units plus two third fold arrangements or four third fold arrangements for use with single or double circumference forme cylinder printing machines is dispensed with through the use of the folder assembly in accordance with the present invention.

BRIEF DESCRIPTION OF THE DRAWINGS

While the novel features of the folder assembly for book folding in a web-fed rotary printing machine in accordance with the present invention are set forth with particularity in the appended claims, a full and complete understanding of the invention may be had by referring to the detailed description of a preferred embodiment, as set forth hereinafter, and as may be seen in the accompanying drawings in which:

FIG. 1 is a schematic side elevation view of a folder assembly in accordance with the present invention with portions of the side frames removed for clarity;

FIG. 2 is a schematic top plan view of the upper and lower third or quarter folders of the present invention and showing the alternate positions of the lower third folder;

FIGS. 4A, 4B and 4C are three schematic examples of book folds producible in the folder assembly in accordance with the present invention.

DESCRIPTION OF THE PREFERRED EMBODIMENT

Figure 3:
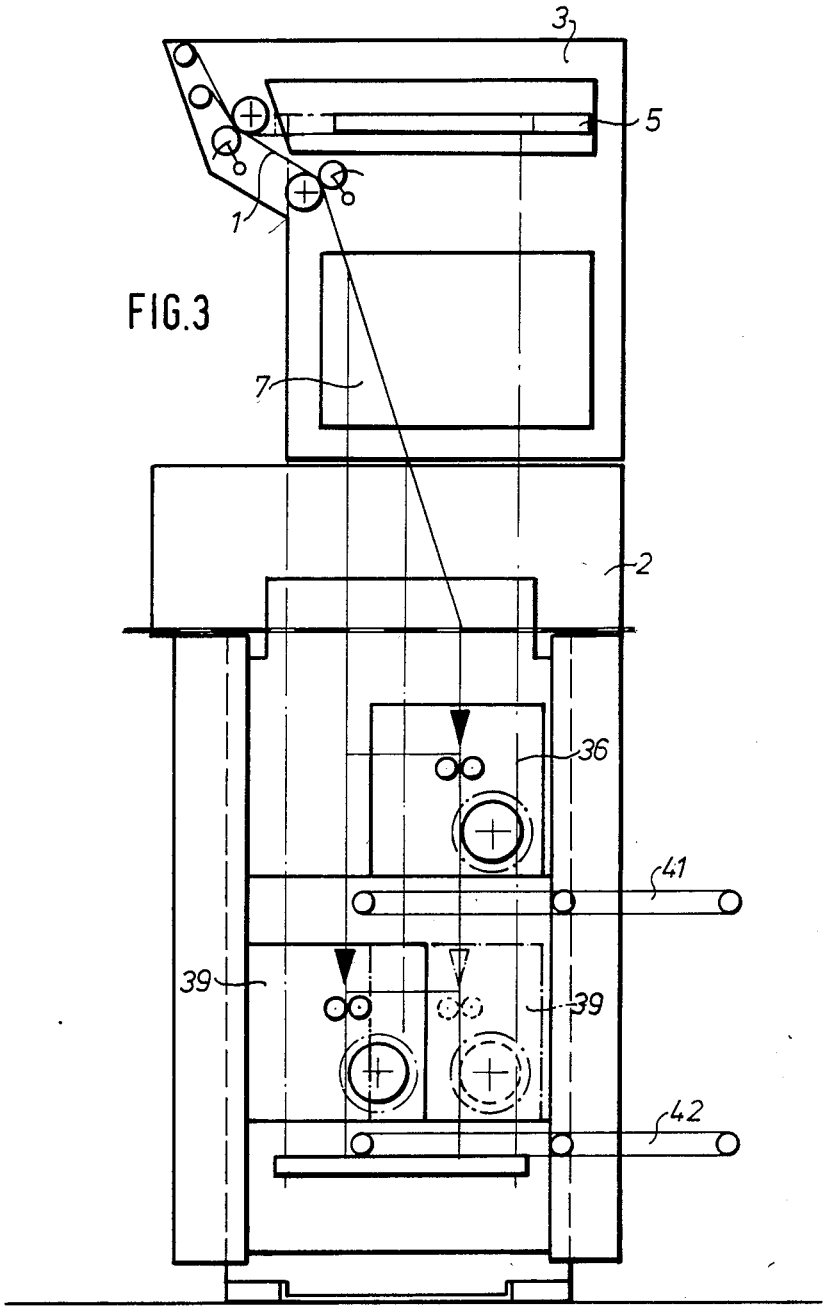
FIG. 3 is an end view of the folder assembly in accordance with the present invention and taken along line III—III of FIG. 1.

Referring intially to FIGS. 1 and 3 there may be seen a folder assembly for book folding in a web-fed rotary printing machine in accordance with the present invention. A paper web, generally at 1 is printed in a known manner by printing units which are not shown. The printing units may have forme cylinders of single circumference, in which the circumference of the forme cylinder corresponds to one length to be cut by the cutting cylinder of the folding assembly, or of double circumference in which the circumference of the forme cylinder corresponds to two lengths to be cut by the cutting cylinder of the folding apparatus. In the single circumference machine two copies are printed while in the double circumference machine there are four copies printed. The paper web 1 is directed to a folder assembly, generally at 2, which, in accordance with the present invention, allows for several possible product configurations.

The folder assembly in accordance with the present invention facilitates the production of either an array of either 2×8 pages or of 1×16 pages for a full width paper web when the printing units are equipped with single circumference forme cylinders. Both of these alternatives are when the folder is operating in the non-collect mode. In printing units having forme cylinders of double circumference, the folder assembly can produce 4×8 pages or 2×16 pages uncollected or 1×32 pages in collect run production. In all cases a page is to be understood as a book page measuring; for example, 315 mm×241 mm. In the above examples, a term such as 2×8 pages indicates that from one paper web two signatures of eight pages each are produced per revolution of the forme cylinder when the folder is operating in straight run production.

The operation of folder assembly 2 will now be discussed in the operational mode in which a single full width web of paper is printed and folded. For the 2×8 production mode, the full width paper web is guided out of its position between side frames 4 and 6 and out from an angle bar framework 3 by means of an angle bar 5 which can be seen in FIG. 3. The web 1 is fed past a longitudinal former 7 which, in this mode, is not utilized and past two undriven former folder rollers 10. Web 1 is then introduced into a longitudinal slitter arrangement 9 which could alternatively be changed to a driven longitudinal perforating and/or scoring arrangement 11. The now longitudinally slit web 1 then runs through a cross perforating arrangement 12, driven second feed rollers 13, and between a cutting blade cylinder 14 and a pin-holing and folding blade clyinder 16, referred to in the following briefly as the folding blade cylinder 16. The cutting cylinder 14 is designed as a 2/2 cylinder and thus carries two cutting knives 19 arranged diametrically opposite each other. The folding blade cylinder 16 is a 3/2 cylinder and carries three controlled pin-holing systems 22 and controlled folding blades 23 which are arranged around its periphery at regular intervals. The folding blade cylinder 16 is, if the printing units are equipped with cylinders of double circumference, additionally designed as a collecting cylinder. The folding blade cylinder 16 co-operates with a 4/2 folding jaw cylinder 24 which is equipped with four controllable folding jaw sets 26. It can also be provided with four controllable folding blades 27, if desired. Each of the four folding jaw sets 26 is separated into left-hand folding jaws 15 and right-hand folding jaws 20, which are thus each half the width of the cylinder 24. All of the left-hand 15 and all of the right-hand folding jaws 20 can be controlled separately and each can be turned off if desired. Control is achieved such that for the 2×8 page production mode, the left-hand folding jaws 15 always open to receive a signature delivery from a left-hand signature stream generated by folding blade cylinder 16 and to deliver the signature to a first transport tape system 32. The right-hand folding jaws 20 always open to receive the signature transfer from the right-hand signature stream and to deliver the signature to a gripper cylinder 28. Gripper cylinder 28 is a 3/2 cylinder which, as may be seen in FIG. 1, is placed below folding jaw cylinder 24 and cooperates with it. It has three sets of controllable gripper rows 31 and can also have controllable folding jaws 29.

First transport tape system 32 and a consecutive second transport tape system 33 transport signatures from the folding jaw cylinder 24 to a first or upper third or quarter fold arrangement, generally at 36, which forms a longitudinal fold in the signatures. The first transport tape system 32 operates at a transport speed equal to the peripheral speed of the folding jaw cylinder 24 while the second transport tape system 33 operates at a substantially slower speed. Typically the speed of the second transport tape system 33 is ½ that of the peripherial speed of the first folding jaw cylinder 24.

A signature switch assembly, shown somewhat schematically in FIG. 1 at 34 is positioned at the point of transfer of signatures away from folding jaw cylinder 24. Signature switch 34 operates syncronously with the signatures in a generally know manner and can be turned on or off. If signature switch 34 is activated, it directs every other signature to the upper transport tape assembly comprised of first and second transport tapes 32 and 33, respectively. Alternate ones of the signatures; i.e., those not fed to the upper transport tape assembly, are directed to the gripper cylinder 28.

A lower transport tape assembly which is comprised of a third transport tape 37 and a fourth transport tape 38 is located adjacent gripper cylinder 28. The third transport tape 37 operates at a peripheral speed the same as gripper cylinder 28 while fourth transport tape 38 is operable at a substantially slower speed which typically is about ½ that of the peripheral speed of gripper cylinder 28. This lower transport tape assembly conveys signatures from gripper cylinder 28 to a second, lower third or quarter fold arrangement, generally at 39, as may be seen in FIGS. 1, 2, and 3.

As may be seen in FIGS. 1 and 3, upper third fold arrangement 36 and lower third fold arrangement 39 are positioned at different heights with lower third folder 39 being positioned below and to the left of upper third folder 36, as seen in FIG. 1. The upper third fold arrangement 36 is placed at generally the same height as the folding jaw cylinder 24. It is not shiftable or displaceable and produces a longitudinal fold in a left hand part paper web 17 which has been formed from full width web 1 that had been longitudinally slit by the slitter arrangement 9. A delivery transport tape system 41 is provided for the upper third fold assembly 36 and runs generally parallel to the axis of rotation of folding jaw cylinder 24, as may be seen in FIG. 1. Upper third fold arrangement 36 is aligned such that its fold line and a mid-point of the left hand paper web portion 17 of web 1 are in alignment.

As may be seen in FIG. 3, the lower third fold arrangement 39 is shiftable laterally in a direction parallel to the axis of rotation of gripper cylinder 28. Lower third folder 39 can be positioned either so it is aligned with upper third folder 36 or alternatively can be shifted to the right, as seen in FIG. 3, so that its folding line, and a mid-point of a right-hand paper web segment 18 severed from paper web 1 by slitter 9 are in alignment. The fourth transport tape system 38 is shiftable with lower third folder 39. Lower third folder 39 is also provided with a deliver transport tape 42 which is positioned, as seen in FIG. 3, so that it will always underlie the lower third folder 39.

In the production position previously indicated; i.e., when the paper web 1 is slit by the longitudinal slitter 9 and in which two signatures of eight pages each are formed, the upper third folder 36 is positioned to the left, as seen in FIG. 2 while the lower third folder 39 is located to the right. In this orientation the folder lines of the upper and lower third fold assemblies 36 and 39, respectively, are separated by a distance equal to half the width of the paper web 1. The left-hand folding jaws 15 of folding jaw cylinder 24 receive the left-hand segment 17 of paper web 1 and deliver the signatures to the first and second top transport systems 32 and 33, respectively, which make up the upper tape transport assembly. The right-hand folding jaws 20 of folding jaw cylinder 24 deliver signatures to the gripper rows 31 of the gripper cylinder 28 from where they are transferred by the third and fourth transport tapes 37 and 38, respectively, of the lower transport tape assembly to the lower third folder 39. The signatures from the left folding jaws 15 and the right folding jaws 20 of folding jaw cylinder 24 have each been provided with one cross fold prior to their delivers to the upper and lower third fold assemblies 36 and 39, respectively. In each of the third folders, the previously cross folded signatures are given their first longitudinal folds so that they have a format such as is shown in FIG. 4A. These now longitudinally folded signatures, are delivered to the upper and lower delivery transport tapes 41 and 42 from upper and lower third fold assemblies 36 and 39, respectively.

Turning now to a production mode in which it is desired to produce a 1×16 signature; i.e., a signature comprised of 16 pages formed during one revolution of the forme cylinder, several changes to the folding assembly in accordance with the present invention are made. The previously utilized slitter 9 is exchanged for a longitudinal scoring and/or perforating assembly 11 of generally conventional structure. The lower third fold assembly 39 is shifted and secured to a position in which it is in alignment with the upper third folder 36. In this orientation, the folding lines of both third folders 36 and 39 are aligned in a common vertical plane. The paper web, which had previously been fed past the longitudinal former 7, is now directed to be run through former 7 which operates to put a first longitudinal fold in the paper web 1. Paper web 1 is first folded by longitudinal former 7, is then fed through former folder rollers 10, and is then pulled by a pair of fed rollers 8. The now longitudinally folded web 1 may then be longitudinally scored and/or perforated by the perforating and scoring assembly 11 and is then cut by cutting knives 19 on the cutting cylinder 14. The now cut web segments are taken over by the controllable pin-holing systems 22 on the folding blade cylinder 16. The controlled folding blades 23 press the signatures into the left-hand folding jaws 15 of the folding jaw cylinder 24. In this mode of operations, the right-hand folding jaws 20 of folding blade cylinder 24 are turned off and thus do not operate. The signature switch 34 can now be utilized in one of the following sequences:

I. Signature switch 34 is switched on and off to the folding jaw cylinder 24 in time with the signatures as they arrive. Alternative signatures are delivered to the first transport tape system 32. The remaining signatures are delivered to the gripper cylinder 28.

II. Signature switch 34 is switched on to the folding jaw cylinder 24. All signatures are delivered to the first transport tape system 32.

III. Signature switch 34 is switched off the folding jaw cylinder 24. All signatures are delivered to the gripper cylinder 28 and thus to the third transport tape system 37.

Placement of the signature switch 34 in mode I delivers the signatures from folding jaw cylinder 24 alternatively to the upper third fold assembly 36 and to the vertically aligned lower third fold assembly 39 where the signatures receive their third fold. In this mode of production, this third fold is a second longitudinal fold, the first longitudinal fold having been formed by longitudinal former 7 and the second fold being the cross fold formed by the folding blades 27. In this mode, the second and fourth transport tape systems 33 and 38, respectively, operate at approximately ½ the transport speeds of the first and third transport tape systems 32 and 37, respectively. It will be understood that signatures carried around on folding jaw cylinder 24 to gripper cylinder 28 are gripped by the controlled gripper rows 31 on gripper cylinder 28 and are carried around by gripper cylinder 28 to the third transport tape system 37 and thence to the fourth tape transport system 38 running at half of tape system 37's transport speed, and to lower third folder 39 where the signatures receive their second longitudinal fold as discussed above. Since in mode I the signatures are delivered to first and third transport tapes 32 and 37 in a spaced array, operation of second and fourth tape transports 33 and 38 at half speed results in a constant signature delivery to upper and lower third fold assemblies 36 and 39, respectively.

When signature switch 34 is placed in either of operating modes II or III, all of the signatures are delivered either to the upper third folder 36 or to the lower third folder 39, respectively. In either of these two operating positions, the transport speeds of all four tape systems 32, 33, 37, and 38 are the same with this speed corresponding to the peripheral speed of the folding jaw cylinder 24.

While a preferred embodiment of a folder assembly for book folding in a web-fed rotary printing machine in accordance with the present invention has been set forth fully and completely hereinabove, it will be evident to one of skill in the art that a number of changes in; for example, the type of printing press used, the number of cutting knives, folding blades and the like, the type of tape transport systems and other similar changes could be made without departing from the true spirit and scope of the present invention which is acoordingly to be limited only by the following claims.

What is claimed is:

1. A folder assembly for book folding a web printed in a web-fed rotary printing machine, said folder assembly comprising:

means for directing said printed web to a rotatable cutting cylinder, said cutting cylinder severing said web into signatures and cooperating with a rotatable folding blade cylinder which cross folds said signatures;

a rotatable folding jaw cylinder having folding jaws which receive said cross folded signatures from said folding blade cylinder;

a rotatable gripper cylinder having gripper rows and cooperable with said folding jaw cylinder to receive selected ones of said cross folded signatures;

an upper third fold assembly and a lower third fold assembly, said upper third fold assembly being stationary and said lower third fold assembly being displaceable in a horizontal plane generally parallel to an axis of rotation of said folding jaw cylinder, each of said upper and lower third fold assemblies being operable to form a longitudinal fold in said cross folded signatures; and an upper transport tape assembly extending between said folding jaw cylinder and said upper third fold assembly and a lower transport tape assembly extending between said gripper cylinder and said lower third fold assembly.

2. The folder assembly of claim 1 wherein said means for directing said printed web to said cutting cylinder includes a longitudinal former and a longitudinal scoring and perforating assembly.

3. The folder assembly of claim 1 wherein said means for directing said printed web to said cutting cylinder includes an angle bar and a longitudinal slitter.

4. The folder assembly of claim 1 wherein said folding jaw cylinder is provided with folding jaw sets separated into left and right folding jaws each of generally one half the width of said folding jaw cylinder, said left and right folding jaws being controllable independantly of each other.

5. The folder assembly of claim 1 wherein each of said upper and lower transport tape assemblies is comprised of two transport tape systems, a first of each of said transport tape systems being positioned adjacent its cooperating cylinder and having a transport speed the same as the peripheral speed of its associated cylinder, a second of each of said transport tape systems being positioned adjacent its cooperating third fold assembly and being operable at a transport speed substantially less than the transport speed of each of said first transport tape systems.

6. The folder assembly of claim 1 further wherein a controllable signature switch is positioned between said folding jaw cylinder and said upper tape transport system.

7. The folder assembly of claim 1 wherein said folding jaw cylinder is operable as a collecting cylinder.

* * * * *